United States Patent [19]

Carson

[11] 4,012,069

[45] Mar. 15, 1977

[54] LOADING APPARATUS

[76] Inventor: William S. Carson, 218 Escambia Drive, Winter Haven, Fla. 33880

[22] Filed: Mar. 31, 1976

[21] Appl. No.: 672,056

[52] U.S. Cl. ..... 294/70; 214/147 G; 294/88

[51] Int. Cl.[2] ..... B66C 3/16

[58] Field of Search ..... 294/70, 88, 106, 107, 294/115; 37/2 R, 117.5, 183 R, 184; 214/145 R, 147 R, 147 G, 656, 657, 767

[56] References Cited

UNITED STATES PATENTS

| | | | |
|---|---|---|---|
| 1,762,946 | 6/1930 | Atkinson | 37/184 X |
| 3,517,960 | 6/1970 | Mork et al. | 294/115 X |
| 3,567,050 | 3/1971 | Pasquazzi et al. | 214/147 R |
| 3,651,966 | 3/1972 | Willett | 214/147 G |
| 3,730,367 | 5/1973 | Heffington | 214/147 G X |

*Primary Examiner*—Johnny D. Cherry

[57] ABSTRACT

A loading apparatus includes a bucket which performs three functions — it serves as a brush loader, a trash loader, and clamshell bucket. The bucket includes a pair of arcuate jaws which are pivotable between a closed position in which the edges of the jaws are positioned adjacent each other and an open position in which the edges of the jaws are spaced apart. Each bucket jaw includes a set of arcuately extending ribs which are adapted to engage and pick up brush and a set of relatively pointed teeth which extend inwardly beyond the ribs and are adapted to engage and pick up trash.

4 Claims, 7 Drawing Figures

LOADING APPARATUS

BACKGROUND AND SUMMARY

This invention relates to a loading apparatus, and, more particularly, to a loading apparatus which is suitable for use as a clamshell bucket, as a brush loader, and as a trash loader.

Various loading devices have heretofore been available which are suitable for a particular loading function. For example, clamshell buckets can be used to pick up relatively fine material such as dirt, sand, and the like. Other loading devices are suitable for use in loading brush such as bushes, branches, twigs, and the like. Still other loading devices can be used to load assorted trash and junk of various shapes and sizes. However, since each type of loading device is relatively expensive and since each type of loading device is inefficient for use in loading operations for which it was not specifically designed, a need exists for a loading apparatus which can be used for each of the three foregoing operations.

The invention provides a loading apparatus which includes a unique bucket which is provided with two sets of teeth. One of the sets of teeth comprises generally arcuately extending ribs which are suitable for engaging and lifting brush, and another set of teeth comprises relatively pointed tines which extend inwardly from the first set of teeth and which are engageable with assorted trash as the jaws of the bucket close. The pointed tines do not interfere with the engagement of the arcuate ribs with brush since the tines will pierce the brush, and the arcuate ribs do not interfere with the engagement of the tines with trash since the tines extend inwardly beyond the ribs and will engage the trash before the ribs. Each of the jaws of the bucket includes a lip or jaw edge which cooperates to provide clamshell operation.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
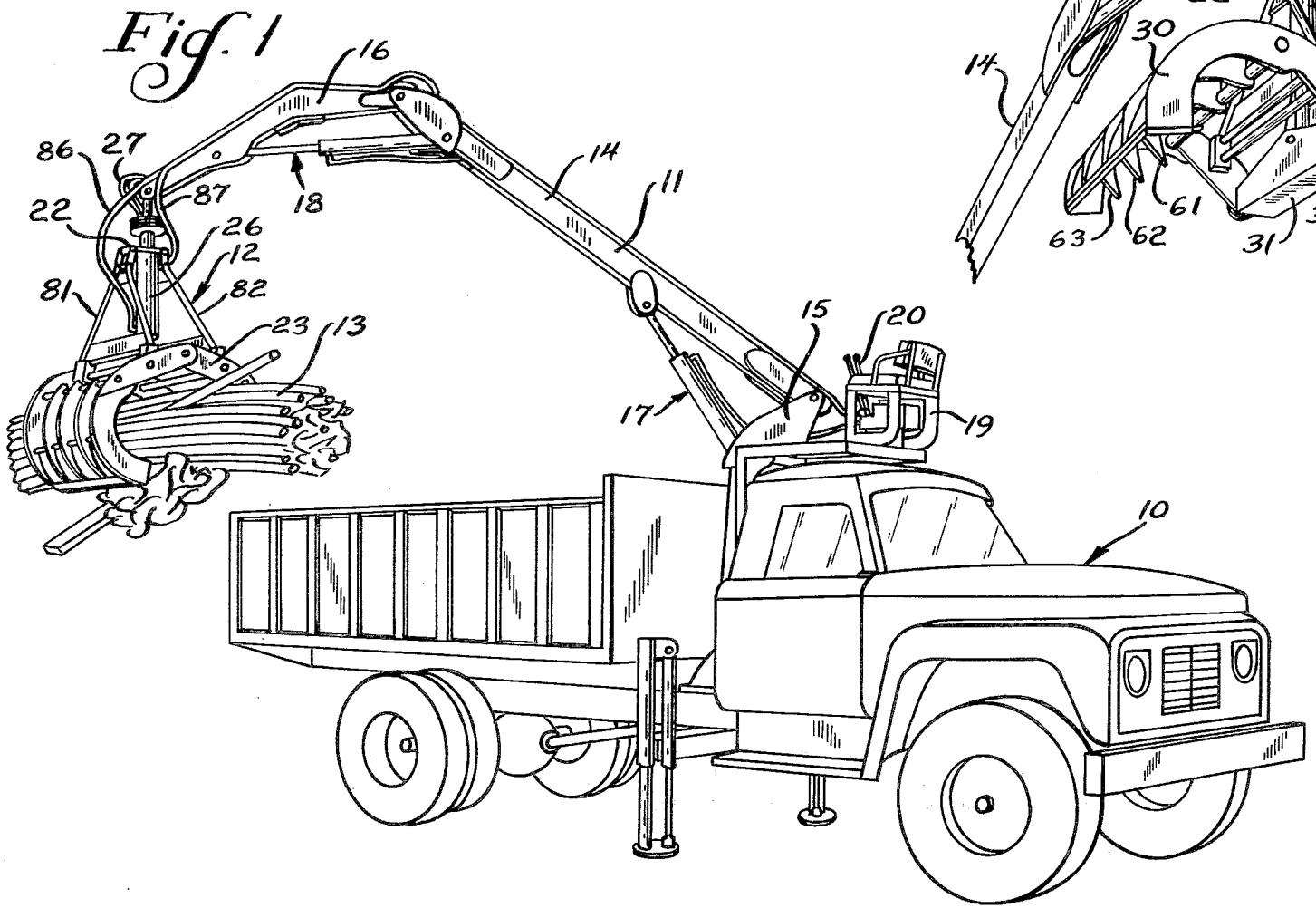
FIG. 1 is a perspective view of a truck equipped with a lifting boom and a loading apparatus which is formed in accordance with the invention.

Referring first to FIG. 1, the numeral 10 designates generally a dump truck which is equipped with a lifting boom 11 which supports a loading apparatus 12. The loading apparatus is grasping a load 13 which consists essentially of brush, i.e., branches and bushes, and the lifting boom is in the process of lifting the loading apparatus to a position over the container body of the dump truck.

The lifting boom 11 is a hydraulically operated two-part boom of the type commonly used in the citrus industry as well as other industries. The lift device includes a primary boom 14 which is pivotally supported by a base 15 and a secondary or tip boom 16 which is pivotally mounted on the end of the primary boom. A hydraulically operated piston and cylinder assembly 17 connects the base and primary boom and permits the primary boom to be raised and lowered. Another hydraulically operated piston and cylinder assembly 18 connects the primary boom and the secondary boom and permits the secondary boom to be pivoted about the end of the primary boom. The base 15 is rotatably supported by a mast (not shown), and suitable power means may be provided within the mast for rotating the base. A seat 19 is mounted on the base for supporting the operator of the loading apparatus, and hydraulic controls 20 are mounted conveniently in front of the seat.

Figure 2:
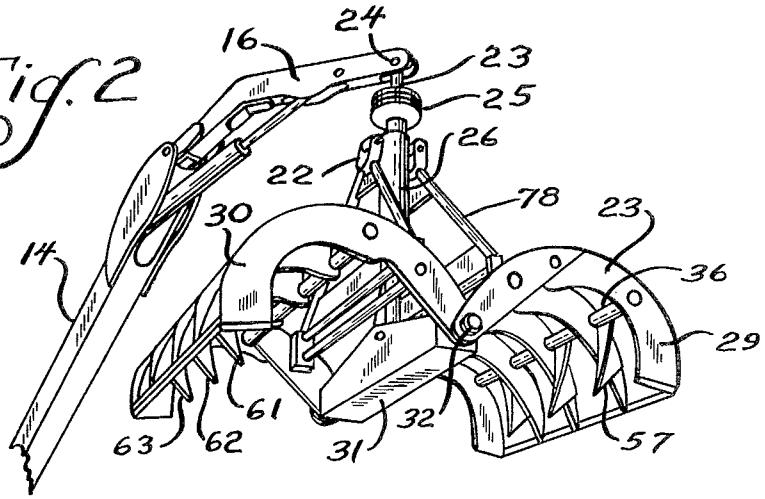
FIG. 2 is a fragmentary perspective view of the lifting boom and the loading apparatus with the bucket jaws in an open position.

The loading apparatus 12 includes a lifting head 22 which is pivotally connected to the end of the secondary boom and a bucket 23 which is supported by the lifting head. The lifting head includes a shaft 23*a* (FIG. 2) which is pivotally connected to the bifurcated end of the secondary boom by a pin 24, a rotating device 25 which is connected to the shaft 23*a*, and a hydraulic motor 26 which is rotatable by the rotating device about a vertical axis. The rotating device 25 is described in co-owned U.S. Pat. No. 3,713,554, to which reference may be had for details, and rotates the hydraulic motor by means of hydraulic hoses 27 (FIG. 1).

Referring now to the remaining figures, the bucket 23 includes a pair of generally arcuately shaped jaws 29 and 39 which are pivotally mounted on an elongated bar 31 by trunnions 32 which extend axially outwardly from the bar.

Figure 4:
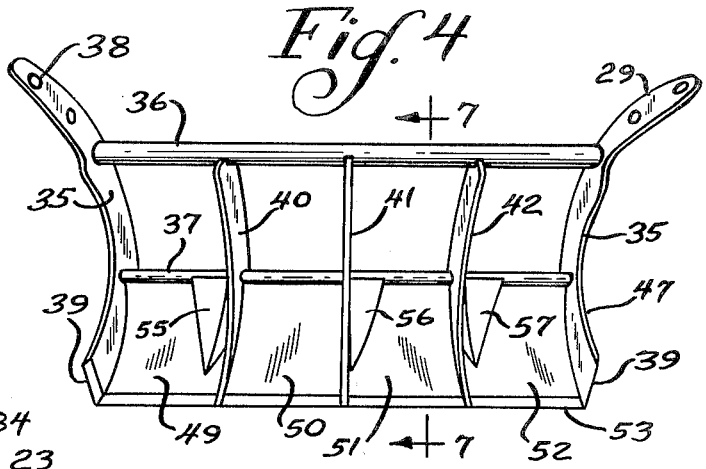
FIG. 4 is a perspective view of one of the bucket jaws.

The jaw 29 (see especially FIG. 4) includes a pair of C-shaped end walls 35 which are connected by a tube 36 and a rod 37. The upper end of each end wall is provided with an opening 38 which fits over the trunnion 32, and the lower end of each end wall terminates in a beveled straight knife edge 39.

Three arcuately shaped ribs 40, 41, and 42 are evenly spaced between the end walls 35 and are secured to the tube 36 and rod 37. Each rib is provided with an opening through which the rod 37 extends and a notch 43 (see FIG. 7) in the upper end thereof which abuts the tube 36. The ribs are secured in place to the tube 36 and rod 37 by welding, and the tube and rod are secured to the end wall by welding. As can be seen best in FIG. 7, each of the ribs 40–42 includes an outer curved edge 44 which is aligned with an outer curved edge 45 of each end wall and an inner curved edge 46. The inner curved edge 46 of each rib is aligned with an inner edge 47 of each end wall in the upper portion of the rib. However, the inner edge of each rib converges toward the outer edge adjacent the bottom of the rib whereas the inner edge 47 of each end wall does not converge with the outer edge but instead extends to the knife edge 39.

Referring again to FIG. 4, curved plates 49, 50, 51, and 52 are positioned between the end walls and adjacent ribs and secured thereto by welding. Each plate curves upwardly from adjacent the lower end of the associated ribs between the inner and outer edges of the ribs to the reinforcing rod 37 and is also welded to the rod. An elongated bar 53 extends from one end wall 35 to the other and is secured to the lower edge of each of the curved plates to provide the jaw with a reinforced lip or edge. The inner edge of the bar is beveled to provide a relatively sharp knife edge.

Figure 7:
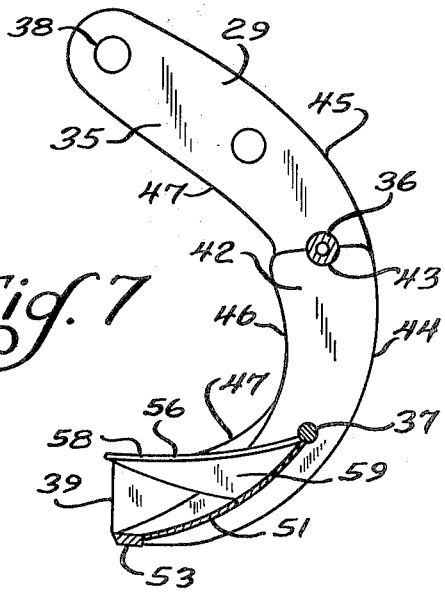
FIG. 7 is a sectional view taken along the line 7—7 of FIG. 4.

Pointed teeth or tines 55, 56, and 57 are secured to the ribs 40–42, respectively, and project inwardly from the rod 37 to adjacent the knife edge 39 of the end walls 35 (FIG. 7). Each of the teeth in the particular embodiment illustrated is generally L-shaped in transverse cross section and includes a curved top plate 58 and a generally vertically extending plate 59. The tooth 55 is secured to the left side of the rib 40 as viewed in FIG. 4, and the teeth 56 and 57 are secured to the right sides of the ribs 41 and 42.

Figure 3:
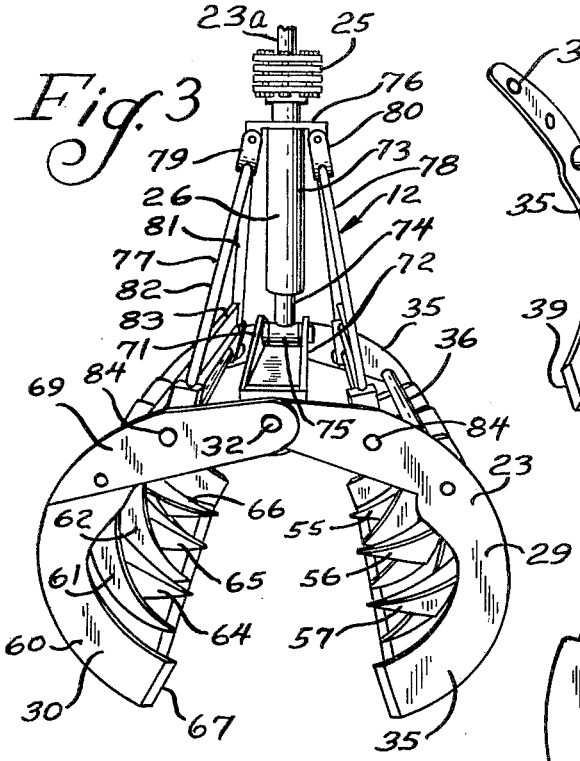
FIG. 3 is a fragmentary perspective view of the loading apparatus with the bucket jaws in a partially open position.
Figure 5:
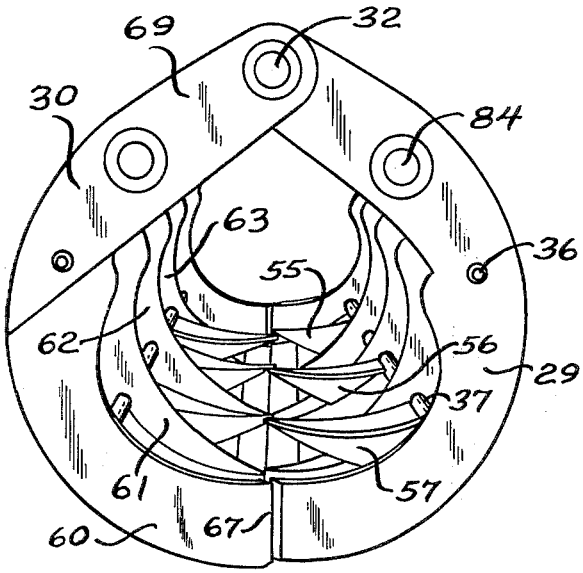
FIG. 5 is a perspective view of the bucket in a closed position.

The other bucket jaw 30 is similarly formed and includes end walls 60 and arcuate ribs 61, 62, and 63 (FIGS. 3 and 5). Pointed teeth 64, 65, and 66 are secured to the ribs 61–63, respectively. The end walls and the ribs of the two jaws are aligned, and the teeth 64–66 of the jaw 30 are secured to opposite sides of the ribs 61–63 as compared to the sides of the ribs 40–42 to which the teeth 55–56 are secured. This means that each tooth on one of the bucket walls will be substantially aligned with a tooth on the other bucket wall but will be out of alignment by the thickness of the ribs. This spacing permits the points of the substantialldy aligned teeth to pass each other without interference when the jaws of the bucket close as shown in FIG. 5. The beveled knife edge 67 of the end wall 60 and beveled edge of the lip-providing bar 68 (FIG. 6) are also slightly out of alignment with the corresponding beveled edges on the jaw 29 to permit these beveled edges to overlap slightly when the bucket jaws close. The upper end of each of the end walls 60 terminates short of the trunnions 32, and a mounting plate 69 is attached to each end wall and is spaced outwardly of the aligned end wall 35 on the trunnion.

The bar 31 to which the bucket jaws are pivotally attached is generally box-shaped in transverse cross section and includes a pair of longitudinally extending generally triangularly shaped side walls 71 and 72 (FIG. 3) which extend upwardly from the box section. The hydraulic motor 26 includes a cylinder 73 and a piston 74 which terminates in a transverse connecting tube 75 which is pivotally connected to the side plates 71 and 72 by a pin passing therethrough.

A collar 76 is attached to the upper end of the cylinder 73, and a pair of generally triangularly shaped hangers 77 and 78 are pivotally connected to the hanger by clevises 79 and 80, respectively. Each of the triangularly shaped hangers includes a pair of rods 81 and 82 which diverge downwardly from the clevis and a reinforcing cross bar 83 adjacent the lower ends of the bars 81 and 82. The hangers 77 and 78 are pivotally connected to the bucket jaws 30 and 29, respectively, by rods 84 which extend through openings in the end walls of the jaws and openings in the lower ends of the hangers bars 81 and 82.

The bucket is shown in a partially open position in FIG. 3. The bucket can be opened more by operating the hydraulic motor 26 to extend the piston 74. As the piston extends, the bar 31 moves downwardly away from the collar 76, and the bucket jaws pivot about the rods 84 which extend through the hangers as the upper ends of the bucket jaws move downwardly with the trunnions 32. This pivoting movement of the bucket jaws causes the edges or lips of the jaws to separate. The bucket is shown in a fully open position in FIG. 2.

Figure 6:
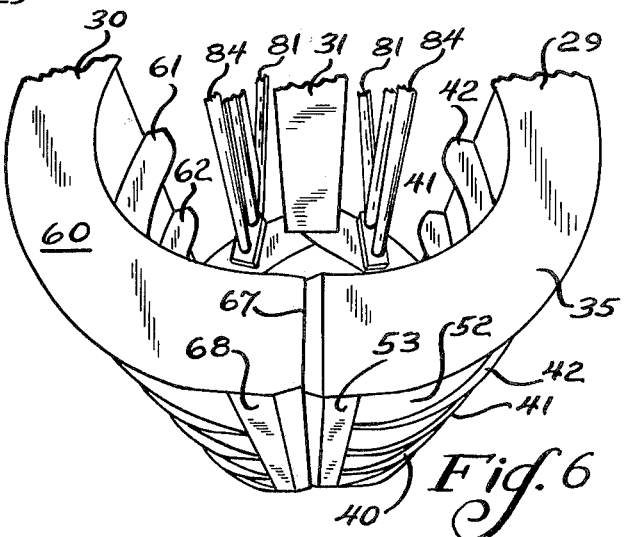
FIG. 6 is a fragmentary perspective view showing the bottom of the closed bucket.

The bucket can be moved to a fully closed position shown in FIGS. 5 and 6 by operating the hydraulic motor to retract the piston 74. As the upper ends of the bucket jaws move upwardly with the trunnions 32, the jaws pivot about the rods 84 to move the jaw edges together. As the trunnions 32 move up and down, the distance between the rods 84 changes, and this change in distance is accommodated by the hangers 77 and 78, which are swingably attached to the hanger 76 by the clevises 79 and 80.

The hydraulic motor 26 is a double-acting motor and is supplied with hydraulic fluid by a pair of hydraulic hoses 86 and 87 (FIG. 1).

The bucket jaws have a skeleton-type frame which is provided by the end walls, the ribs, and the interconnecting tubes or rods 36 and 37. The spaces between the tubes 36 and 37 and the ribs and end walls remain open in the embodiment illustrated, but the spaces below the rod 37 are closed by the side walls which cooperate with the end walls of the jaws to form the clamshell portion of the bucket. I have found it advantageous to terminate the side walls at the rod 37 rather than extending the side walls upwardly to the tube 36. This permits brush and trash to extend through the openings between the ribs to facilitate the closing of the jaws. However, if greater clamshell efficiency is desired, i.e., a larger load is to be lifted by the side walls, the side walls can be extended up to the tubes 36.

The inner edges of the ribs 40–42 and 61–63 and the inner edges of the end walls 35 and 60 of the bucket jaws serve as brush teeth for engaging and lifting brush, i.e., branches, bushes, and the like as shown in FIG. 1. These brush teeth are spaced apart along the pivoting axis of the bucket and provide a multi-toothed brush grapple having a generally cylindrical transverse cross section. The brush teeth encircle and compact a load of brush, and the openings between the ribs permit branches to extend through these openings rather than interfering with the closing of the jaws.

The teeth 55–57 and 64–66 extend inwardly beyond the inner edges of the ribs and serve as trash-engaging teeth. These teeth do not interfere with the brush-loading function of the apparatus since the pointed teeth will pierce the brush as the jaws close. However, when the loading apparatus is used to load trash, the pointed teeth will engage and dig into the trash to permit the trash to be loaded. Since the pointed teeth extend inwardly beyond the ribs, the ribs will not interfere with the engagement of the teeth with the trash.

The upper portions of the beveled knife edges 39 and 67 of the end walls of the jaws 29 and 30, respectively, are pointed and are generally aligned with the points of the trash teeth on the respective jaws. These pointed edges of the end walls also serve as trash-engaging teeth. The points of the trash-engaging teeth, including the points of the end walls, are generally aligned with a plane which extends through the pivot axis provided by the trunnions 32 and the edge of the jaw (see, for example, FIG. 7). The points of the trash-engaging teeth are spaced upwardly from the jaw edge, and this means that as the jaws move from an open position toward the closed position, the points of the trash-engaging teeth will be positioned inwardly of the jaw edge and will engage the trash without interference from the jaw edge.

The type of trash which can be engaged and lifted by the trash-engaging teeth includes such diverse articles as discarded furniture, refrigerators, boards, mattresses, and the like.

The loading apparatus is particularly advantageous for picking up a load which consists of a mixed assortment of trash, brush, and relatively fine material such as dirt, sand, stones, or the like. No segregation of the load is required, and the loading apparatus can be used merely by lowering the open bucket into the load. As the jaws close, the brush will be engaged by the brush teeth provided by the inner edges of the ribs and the end walls, and the jaws will close until the pointed trash-engaging teeth firmly engage a relatively solid piece of trash. The lifting boom is then operated to lift the bucket over the container body of the truck, and both the brush and the trash which is engaged by the bucket will be raised.

This process is continued until all of the brush and trash is loaded. Since the engagement of the pointed trash-engaging teeth will prevent the jaws from completely closing, the relatively fine material will remain. The loading apparatus can then be used as a clamshell bucket to pick up the fine material. In actual operation, the loading apparatus can pick up a mixed load of brush, trash, and fine material so completely that all that remains is a relatively minor amount of fine material which can be swept up.

While in the foregoing specification I have described a specific embodiment of my invention, it will be understood that many of the details hereingiven may be varied considerably by those skilled in the art without departing from the spirit and scope of the invention.

I claim:

1. A loading apparatus for picking up trash, brush, and the like comprising a lifting head adapted to be connected to a lifting boom and a bucket supported by the lifting head, the bucket including a pair of bucket jaws which are mounted for pivotal movement about a generally horizontally axis, each of the bucket jaws including a. a pair of flat, curved end walls extending generally arcuately downwardly from said horizontal axis in a plane which extends generally perpendicularly to the horizontal axis, the end walls being spaced apart in a direction parallel to the horizontal axis and including a pair of flat side surfaces which extend parallel to said plane and curved inner and outer edges, b. a plurality of flat, curved ribs, each of the curved ribs extending generally arcuately downwardly from said horizontal axis between the end walls in a plane which extends generally perpendicularly to said horizontal axis and including a pair of flat side surfaces which extend parallel to said plane and curved inner and outer edges, the ribs being spaced apart in a direction parallel to said horizontal axis, c. a curved side wall secured to the outer edges of the ribs and to the outer edges of the end walls and terminating in a lower edge adjacent the lower ends of the ribs and end walls providing a clamshell edge, d. a tooth secured to one of the flat side surfaces of each of the ribs and extending inwardly beyond the inner edge of the rib and terminating in a trash-engaging point, the points of the teeth being generally aligned with a plane extending from the pivot axis to the clamshell edge, means connected to the lifting head and the bucket for pivoting the bucket jaws between a closed position in which the clamshell edges of the jaws are positioned adjacent each other and an open position in which the clamshell edges of the jaws are spaced apart, the teeth of each of the jaws extending generally toward the teeth of the other jaw when the bucket jaws are closed and the points of the teeth of each of the jaws being positioned adjacent the points of the teeth of the other jaw when the bucket jaws are closed, the curved inner edges of the ribs being engageable with brush and the like when the jaws move toward the closed position and the teeth being engageable with trash with the jaws move toward the closed position.

2. The loading apparatus of claim 1 in which each of said end walls terminates in a generally straight lower edge which extends between the inner and outer edges of the end wall and which provides a point at the juncture of the lower edge and the inner edge, the point of each end wall of each bucket jaw being aligned with the trash-engaging points of the teeth of the bucket jaw in said plane which extends from the horizontal axis to the clamshell edge of the bucket jaw.

3. The loading apparatus of claim 2 in which the upper portions of the inner edges of the end walls of each bucket jaw are horizontally aligned with the upper portions of the inner edges of the ribs of the bucket jaw.

4. The loading apparatus of claim 1 in which the bucket has a generally cylindrical cross section in a direction transverse to said horizontal axis when the jaws are closed, the teeth of the bucket jaws extending along a chord of the cylindrical cross section below the center of the cross section.

* * * * *